US008757731B2

(12) United States Patent
Burger

(10) Patent No.: US 8,757,731 B2
(45) Date of Patent: Jun. 24, 2014

(54) METHOD FOR INTRODUCING A VERTICAL SHAFT AND SHAFT DRIVING MACHINE

(71) Applicant: Herrenknecht AG, Shwanau (DE)

(72) Inventor: Werner Burger, Schwanau (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 13/918,309

(22) Filed: Jun. 14, 2013

(65) Prior Publication Data

US 2013/0277117 A1 Oct. 24, 2013

Related U.S. Application Data

(63) Continuation of application No. 13/054,863, filed as application No. PCT/EP2008/006318 on Jul. 31, 2008.

(51) Int. Cl.
*E21D 1/06* (2006.01)
*E21D 9/10* (2006.01)

(52) U.S. Cl.
CPC .... *E21D 1/06* (2013.01); *E21D 9/10* (2013.01)
USPC ..... 299/58; 299/31; 299/55

(58) Field of Classification Search
CPC ..... E21D 1/06; E21D 9/1006; E21D 9/10
USPC ..... 299/31, 73–78, 55, 56, 58
See application file for complete search history.

(56) References Cited

U.S. PATENT DOCUMENTS 3,355,215 A 11/1967 Haspert
3,598,445 A 8/1971 Winberg
3,965,995 A 6/1976 Sugden
4,189,186 A 2/1980 Snyder
4,548,442 A 10/1985 Sugden et al.
4,646,853 A 3/1987 Sugden et al.
5,192,116 A 3/1993 Turner

FOREIGN PATENT DOCUMENTS

GB 2158129 A 11/1985
JP 2006-249793 A 9/2006

OTHER PUBLICATIONS

Extract of Textbook—Encyclopaedia of Tunnelling, Mining and Drilling Equipment, Barbara Stack, Muden Publishing Company, Hobart, Australia, copyright 1995, Three "Shaft Boring Machines".
UnserBetrieb, Markiert, Dec. 1984.
Blind Shaft Construction New Equipment Update, James E. Friant, SME, Jan. 1979, Chapter 72—Shafts II, Rapid Excavation and Tunneling Conference Proceedings.
Mitteilung Uber Die Ubermittlung Des Internationalen Recherchenberichts Und Des Schriftlichen Bescheids Der Internationlen Recherchenbehorde Oder Der Erklarung, issued by Europaisches Patentamt, for International Application No. PCT/EP2008/006318, Apr. 21, 2009, 13 pages. [International Search Report and Written Opinion].
The International Preliminary Report on Patentability mailed Feb. 17, 2011 in related International Application No. PCT/EP2008/006318.

*Primary Examiner* — David Bagnell
*Assistant Examiner* — Michael Goodwin
(74) *Attorney, Agent, or Firm* — Faegre Baker Daniels LLP

(57) ABSTRACT

The invention relates to a method for introducing a vertical shaft underground and to a shaft driving machine set up particularly for performing the method, wherein a cutting wheel is rotated solely about a horizontal axis until a penetration trough having a predetermined penetration depth is formed, and the cutting wheel is then also rotated about a central vertical axis until a shaft foot is dug out to the penetration depth. A relatively high sinking rate is thereby achieved for the shaft.

3 Claims, 11 Drawing Sheets

III-III

IV-IV

V-V

METHOD FOR INTRODUCING A VERTICAL SHAFT AND SHAFT DRIVING MACHINE

CROSS REFERENCE TO RELATED APPLICATIONS

Figure 1:
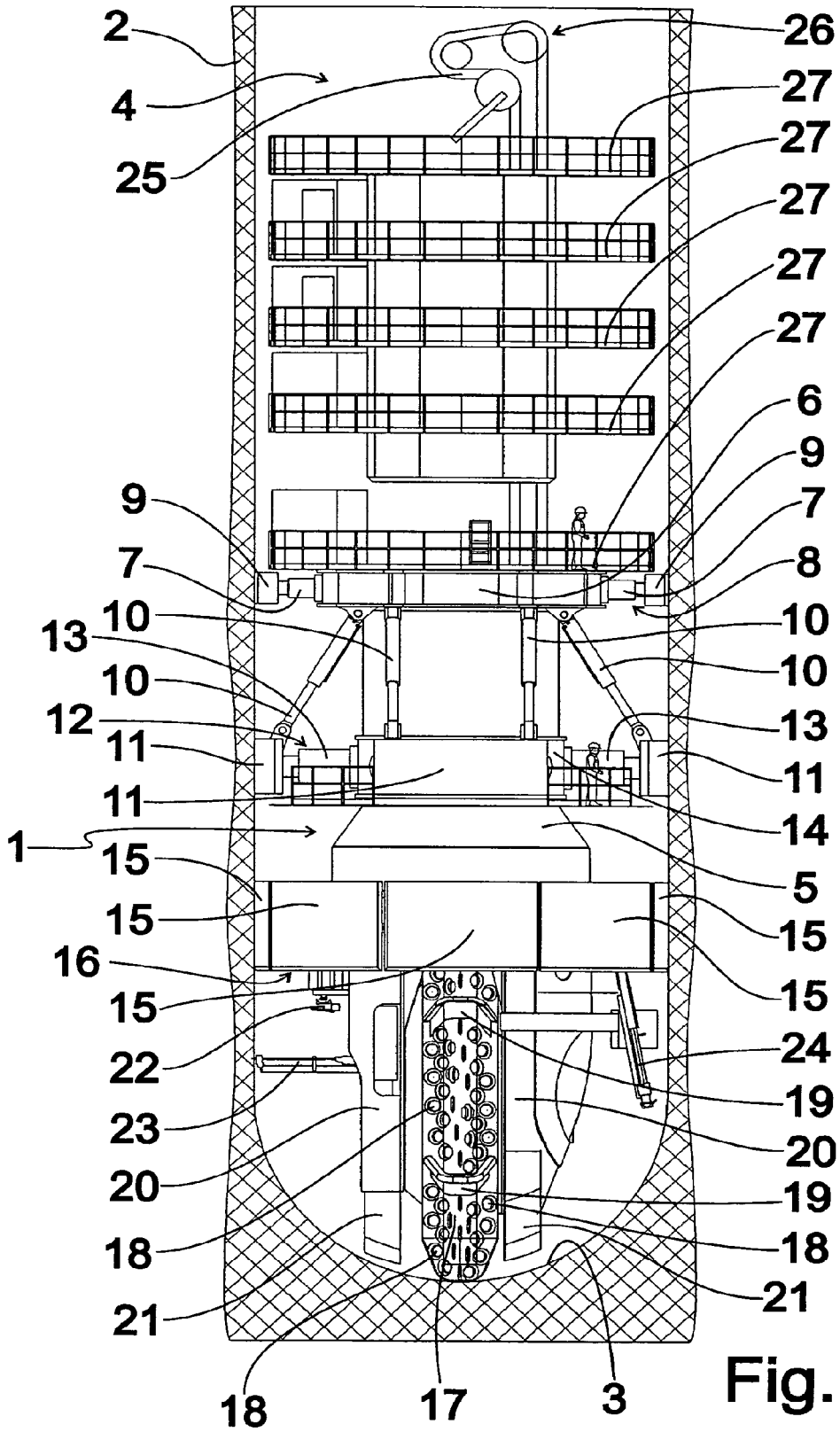

This application is a Continuation of U.S. patent application entitled METHOD FOR INTRODUCING A VERTICAL SHAFT AND SHAFT DRIVING MACHINE, Ser. No. 13/054,863 filed Jan. 19, 2011, which is a U.S. National Stage Application based on International Application No. PCT/EP2008/006318 filed Jul. 31, 2008 entitled METHOD FOR INTRODUCING A VERTICAL SHAFT AND SHAFT DRIVING MACHINE, the entire content of which is expressly incorporated herein by reference.

The invention relates to a method for introducing a vertical shaft underground in accordance with the preamble of patent claim 1.

The invention relates furthermore to a shaft boring machine in accordance with the preamble of patent claim 5.

A method of this type for introducing a vertical shaft underground as well as a shaft boring machine are known from the JP 2006249793 A. In the prior art method and the prior art shaft boring machine a rotatable cutterwheel is rotated continuously about a horizontal axis and a central vertical axis such that a shaft floor is excavated in a substantially even manner over the entire area of the walls.

Another method for introducing a vertical shaft and a shaft boring machine are known from the U.S. Pat. No. 4,646,853. The prior art method for introducing a vertical shaft underground provides a shaft boring machine having a rotatable cutterwheel which can be rotated about a horizontal axis and about a vertical axis at a distance from a central longitudinal axis of the shaft boring machine. By this means, the cutterwheel follows a vertical spiral path such that it continuously excavates a shaft floor wider than the diameter of the cutterwheel.

The invention has the objective of providing a method for introducing a vertical shaft and a shaft boring machine particularly for executing the method of the type specified above, which is distinguished by a relatively high sinking rate.

This objective is achieved with a method of the type specified above according to the invention having the distinguishing characteristics of patent claim 1.

This objective is achieved with a shaft boring machine of the type specified above according to the invention having the distinguishing characteristics of patent claim 5.

Because, with the method according to the invention and with the shaft boring machine according to the invention, the sinking is carried out in two steps with the introduction of a penetration solely by the rotation of the cutterwheel about the horizontal axis and the subsequent rotation of the cutterwheel about the central vertical axis as well, while keeping the cutterwheel in the penetration depth, due to the equipping of the cutterwheel with excavation tools fitted for a method of this type, a relatively high sinking rate may be obtained.

Further functional embodiments of the invention are Objects of the dependent claims.

Further functional embodiments and advantages of the invention may be derived. from the following description of an embodiment example of the invention with reference to the figures of the illustrations. They show:

FIG. 1 An embodiment of a shaft boring machine according to the invention in a side view which is located in a vertical shalt with a view of a radial outer face of a cutterwheel.

Figure 2:
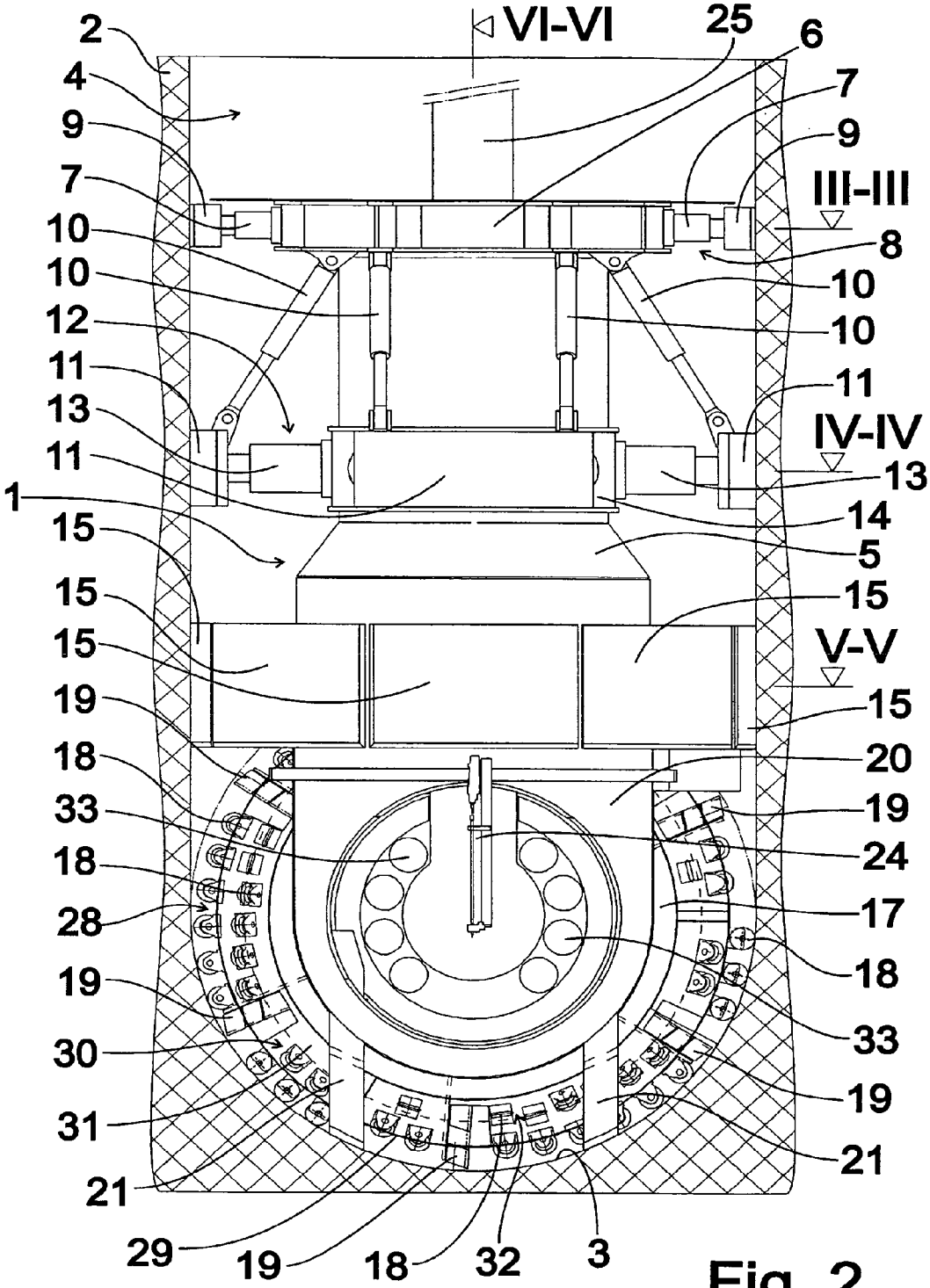

FIG. 2 A side view of the shaft boring machine according to FIG. 1, enlarged and rotated 90° in relation to FIG. 1.

Figure 3:
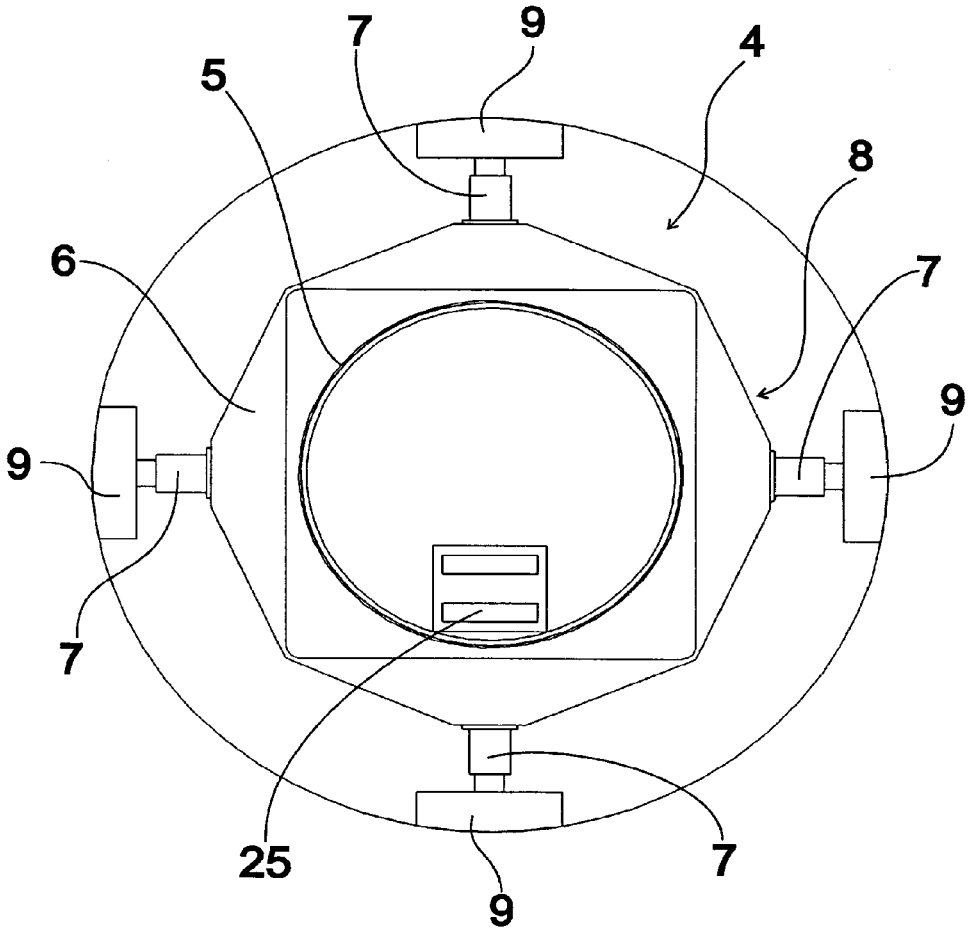

FIG. 3 A cross-section of the shaft boring machine according to FIG. 1 in an alignment unit region.

Figure 4:
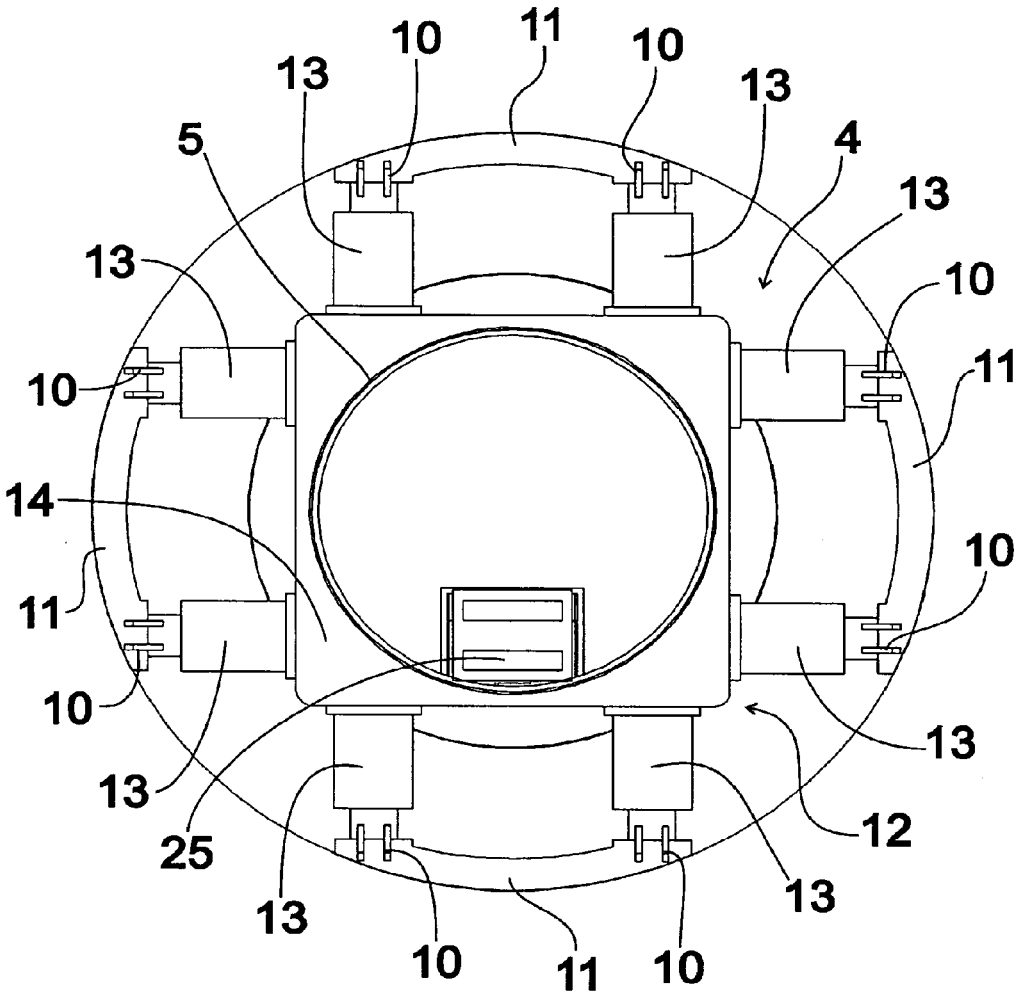

FIG. 4 A cross-section of the shaft boring machine according to FIG. 1 in a bracing unit region.

Figure 5:
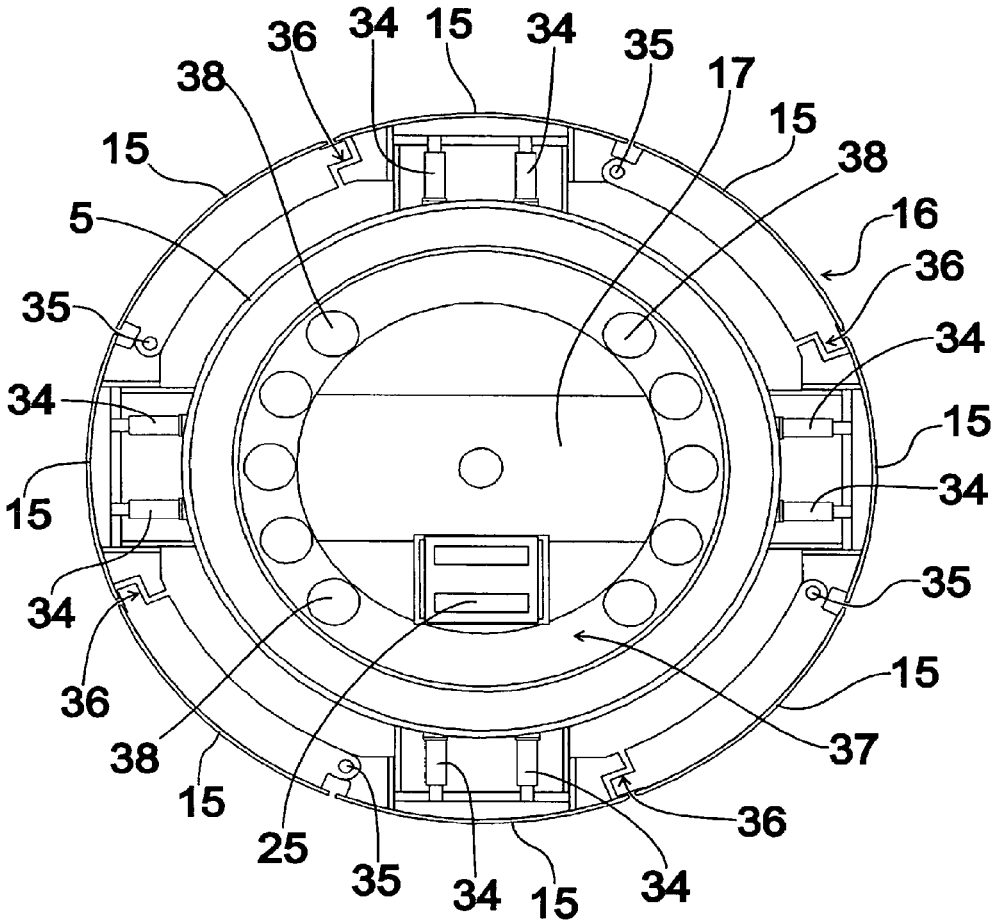

FIG. 5 A cross-section of the shaft boring machine according to FIG. 1 in a dust shield region.

Figure 6:
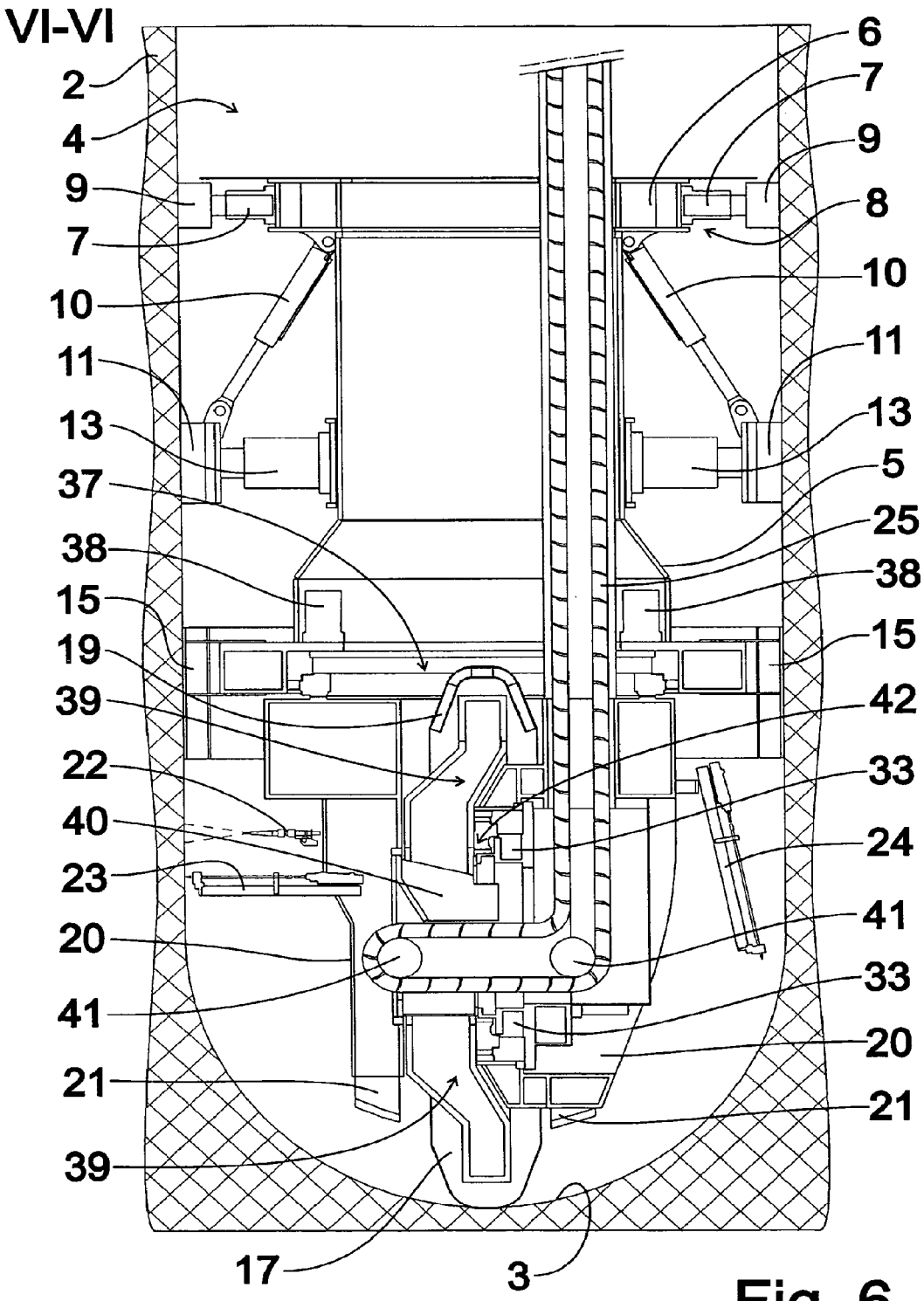

FIG. 6 A longitudinal section of the shaft boring machine according to FIG. 1.

Figure 7:
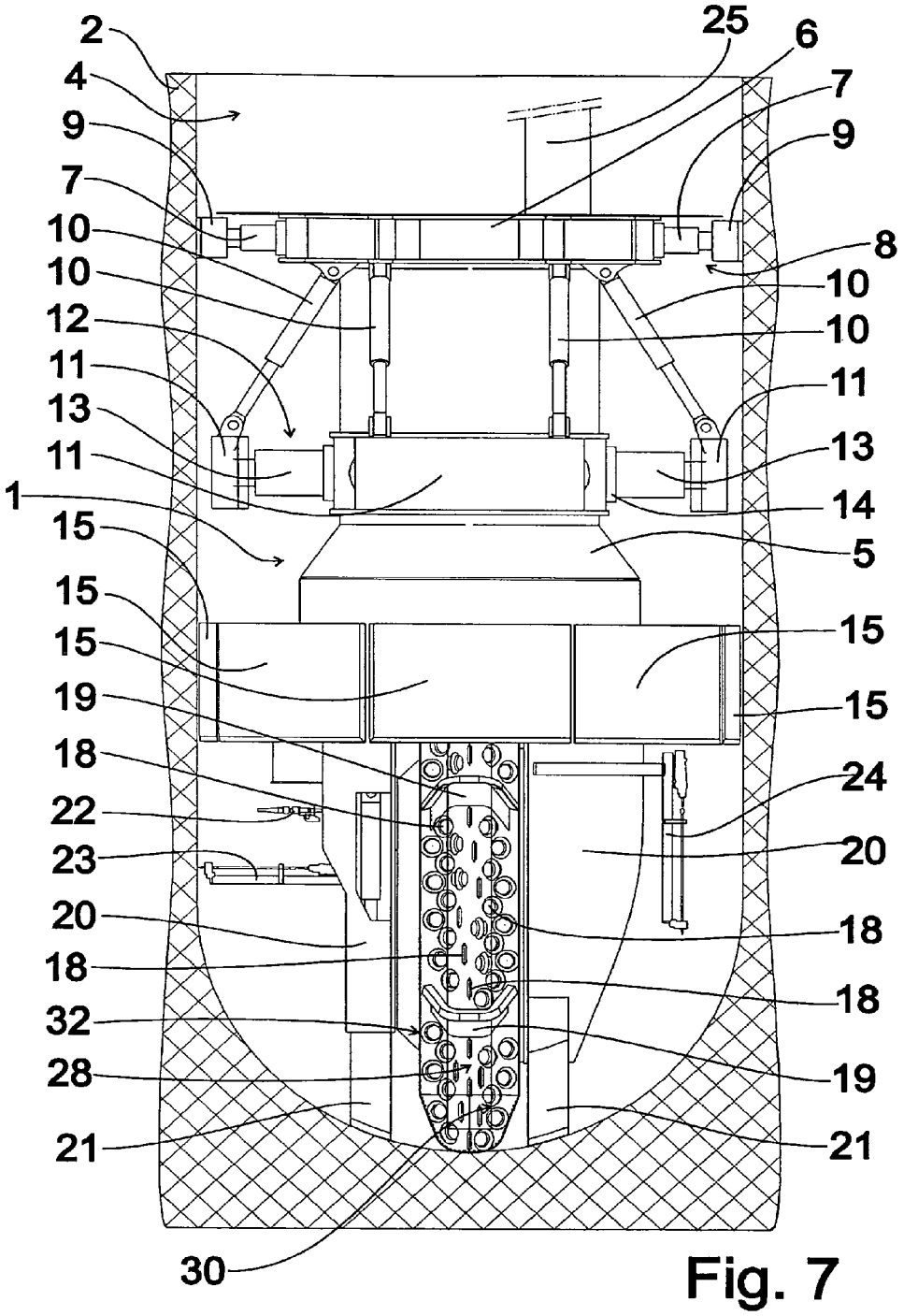

FIG. 7 The shaft boring machine according to FIG. 1 in a side view while executing an embodiment of the method according to the invention in an alignment step.

Figure 8:
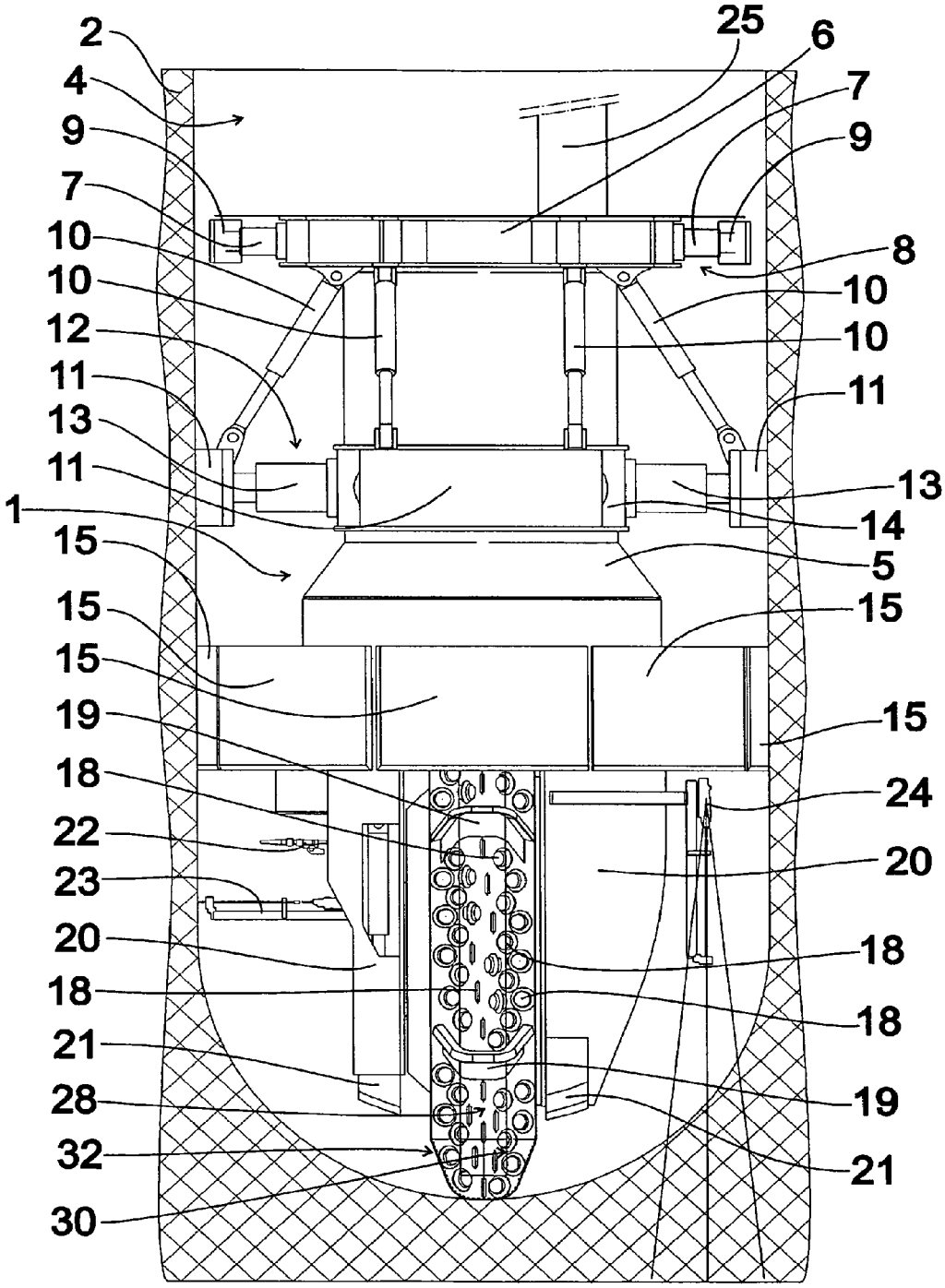

FIG. 8 The shaft boring machine according to FIG. 1 in a side view while executing the embodiment of the method according to the invention directly before starting the cutting of a penetration.

Figure 9:
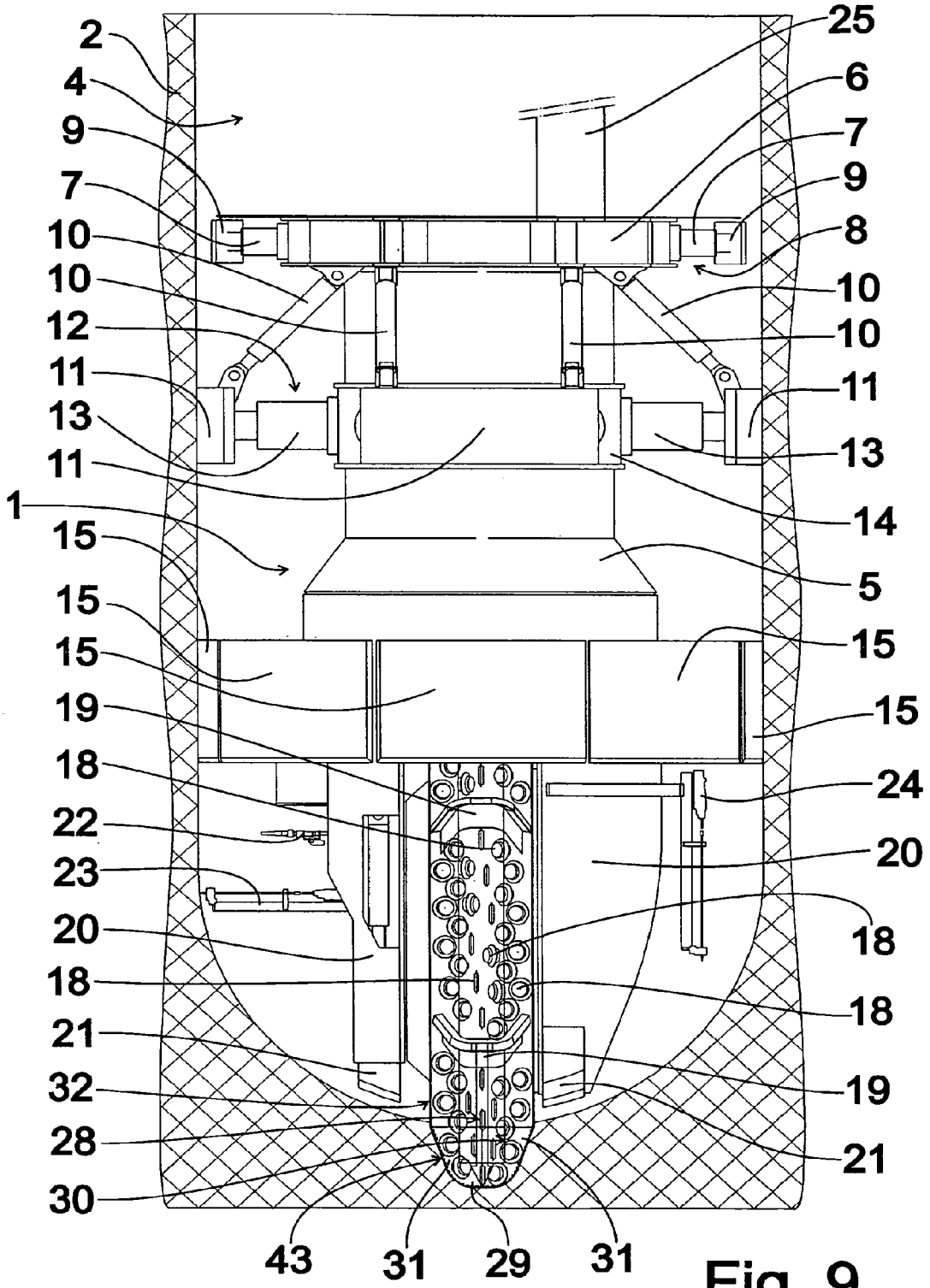

FIG. 9 The shaft boring machine according to FIG. 1 in a side view while executing the embodiment of the method according to the invention after finishing the step of cutting a penetration.

Figure 10:
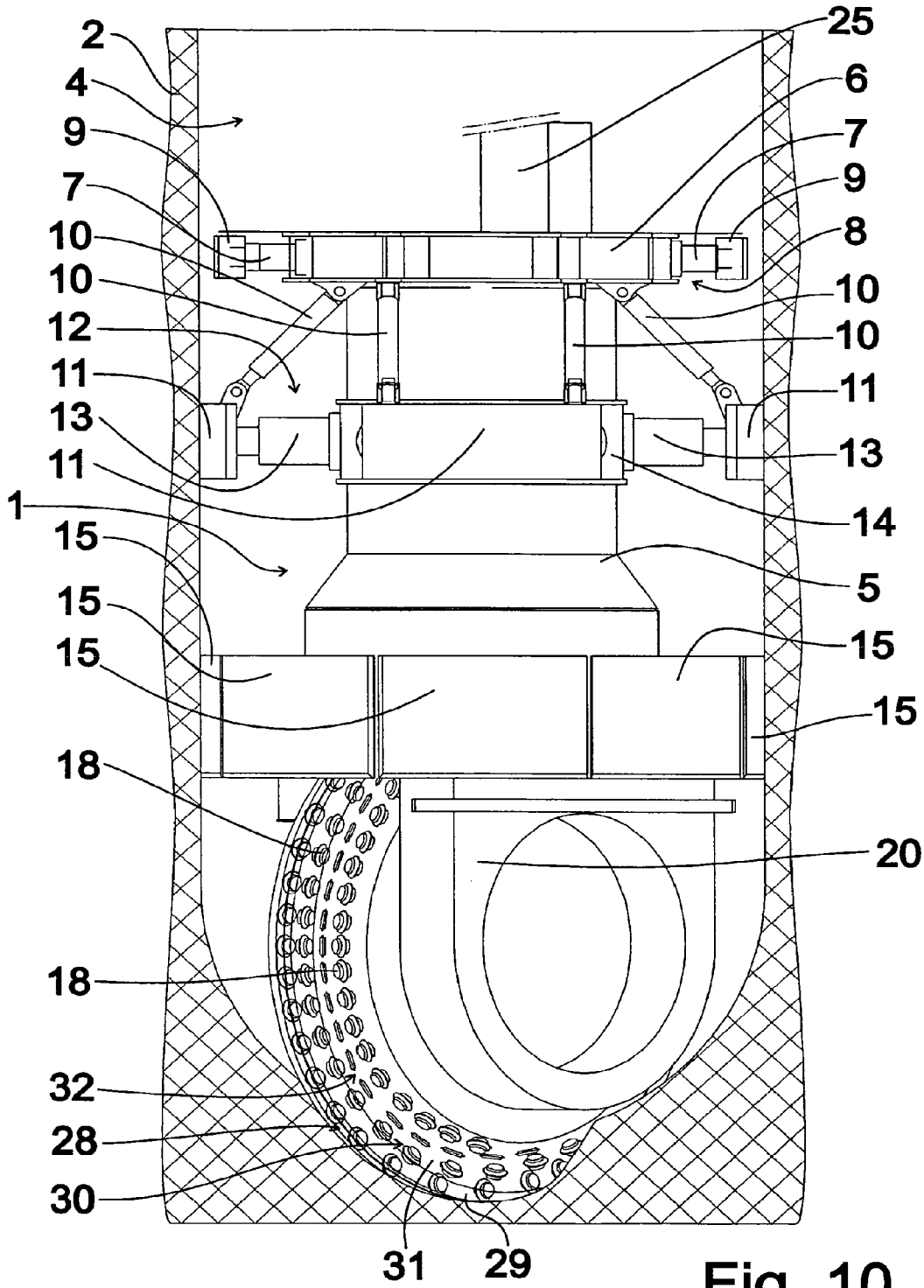

FIG. 10 The shaft boring machine according to FIG. 1 in a side view while executing the embodiment of the method according to the invention during the rotation of the cutterwheel about the central vertical axis as well, to deepen a floor to the depth of the penetration.

Figure 11:
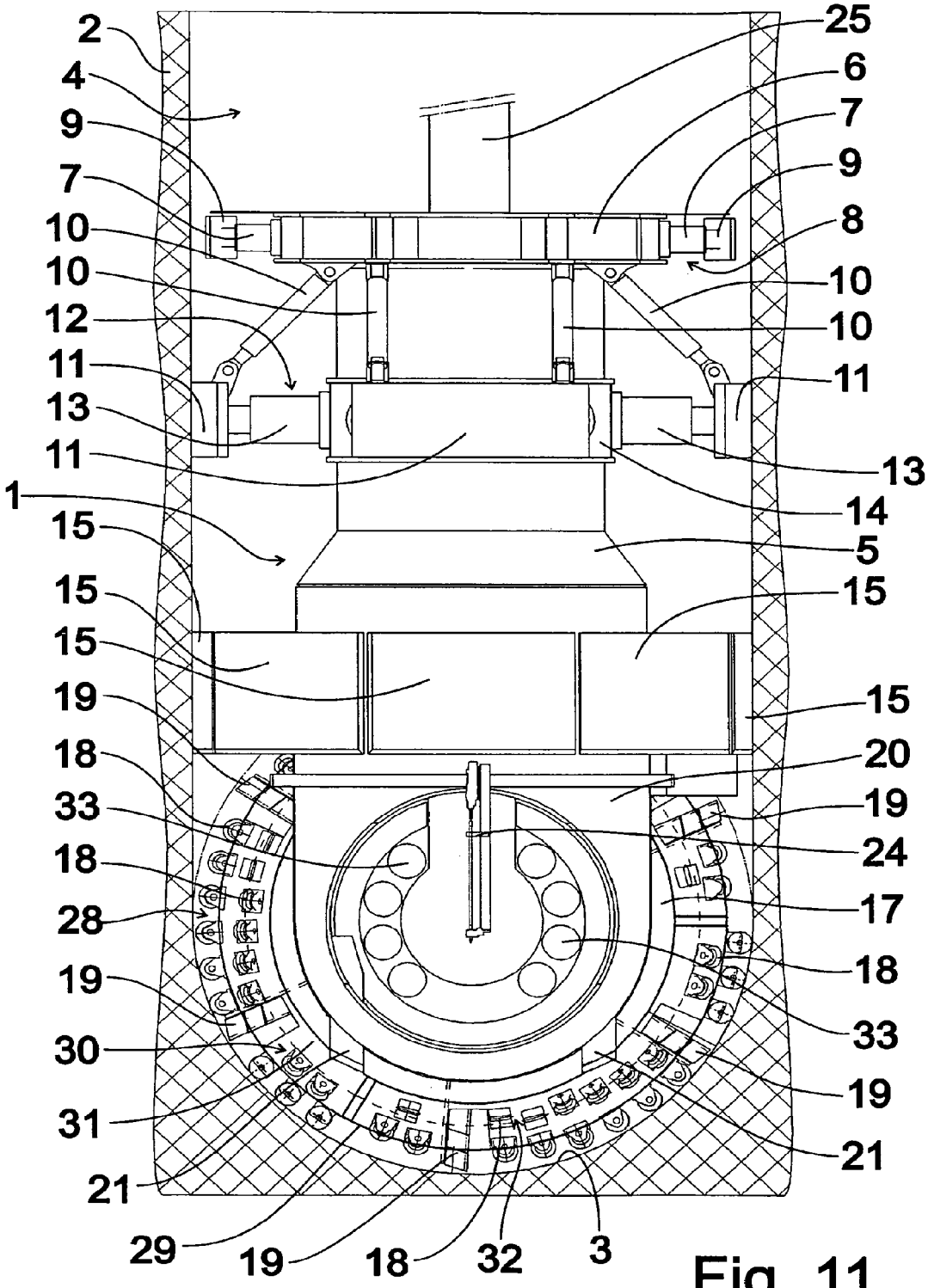

FIG. 11 The shaft boring machine according to FIG. 1 in a side view while executing the embodiment of the method according to the invention after completing the step of deepening the floor to the depth of the penetration.

FIG. 1 show a side view of an embodiment of a shaft boring machine 1 according to the invention, which is placed in shaft 4 extending underground 2 vertically from the surface of the earth to a shaft floor 3. The shaft boring machine 1 has a machine frame 5, to which a retainer ring 6 of a retainer device is attached firmly to the end region of the back as seen from the perspective of the boring direction. There are alignment cylinders 7 of an alignment unit 8 functioning radially outwards fastened on the retainer ring 6, having an alignment foot 9 in each case on the ends away from the retainer ring 6.

Furthermore, a number of driving cylinders 10 are attached to the retainer ring 6, extending diagonally outwards from the machine frame 5 away from the retainer ring 6, the ends of which away from the retainer ring 6 are attached to bracing plates 11 functioning as the bracing means of a bracing unit 12. The bracing unit 12 furthermore has a number of bracing cylinders 13 functioning radially outwards as an additional bracing means, which are attached at one end to the bracing plates 11 and the other end to bracing carriages 14 surrounding the machine frame 5.

On the side of the bracing carriage 14 away from the retainer ring 6 is a dust shield 16 having a number of dust shield segments 15, on the side of which away from the bracing carriage 16 is a cutterwheel 17 which is in a vertical position when in operation. The cutterwheel 17 is rotatable on a horizontal axis and on an axis extending perpendicularly to the horizontal axis as well as said cutting central vertical axis. There are a number of excavating tools 18 arranged on the cutterwheel 17 in the form of rotatable cutting wheels as well as a number of shovel-like scrapers 19.

The cutterwheel 17 is connected to the machine frame 5 with bearing shanks 20 on both sides of the cutterwheel 17 attached in a rotating manner to the machine frame 5. On both sides of the cutterwheel 17 the shaft boring machine 1 has a number of stabilizing feet 21 which can slide in the longitudinal direction of the shaft boring machine 1 between an extended stabilizing position and a retracted, disengaged position.

Furthermore, auxiliary equipment is located on the side of the dust shield 16 facing the shaft floor 3 next to the cutterwheel 17, such as a concrete spraying nozzle 22 for coating the wall of the shaft 4 with spray concrete, an anchor boring rig 23 for placing rock anchors and an advance boring device 24 for placing special borings extending beyond the scope of the shaft floor 3, preferably rotatable over 360° about a vertical axis and preferably rotatable 180° about a horizontal axis.

Finally, it may be derived from FIG. 1 that on the side of the shaft boring machine 1 facing the shalt floor 3 there is a vertical conveyor belt 25 extending in a vertical direction, from which the material excavated from the shaft floor 3 can be unloaded, at an unloading station 26, after passing a number of working platforms 27 located on the side of the shalt boring machine 1 facing away from the shaft floor 3 for the final removal from the shaft.

FIG. 2 shows a side view of the shaft boring machine in accordance with FIG. 1, enlarged and rotated 90° in relation to the illustration in FIG. 1 with a view of the flat side of the cutterwheel 17. From FIG. 2 it is apparent that a first group 28 of excavation tools 18 is arranged on a face 29 of the cutterwheel 17 extending radially outwards, such that their main functional direction is vertically downwards towards the shaft floor 3. A second group 30 of excavation tools 18 is arranged on both sides of the face 29 at the sides 31 of the cutterwheel 17 having a diagonal to vertical alignment to the main functional direction, preferably of 45°. A third group 32 of excavation tools 18 on the side 31 away from the face 29 are arranged with a substantially horizontally oriented main functional direction.

Furthermore, it may be derived from FIG. 2 that the cutterwheel 17 which is rotatable about a horizontal axis in a vertical plane can be driven by a number of horizontal rotation motors 33 distributed over an internal surface for said rotation about the horizontal axis.

FIG. 3 shows a cross-section of the shaft boring machine 1 according to FIG. 1 in the region of the alignment unit 8 along the tine III-III in accordance with FIG. 2. From FIG. 3 it is apparent that the alignment unit 8 has four alignment shoes 9, which are arranged at 90° to each other. It is thereby possible to align the machine frame 5, and thereby the shaft boring machine 1 with a precise vertical position of the central vertical axis, controlled by the means of altering the extension of the alignment cylinders 7 through a central control unit not shown in FIG. 3.

FIG. 4 shows a cross-section of the shaft boring machine 1 according to FIG. 1 in the region of the bracing unit 12 along the tine IV-IV of FIG. 2. From FIG. 4 it may be derived that the bracing unit 12 has four relatively massive bracing plates 11, which, corresponding to the alignment shoes 9 of the alignment unit 8, are arranged at 90° to each other. Each bracing plate 11 is connected externally to two bracing cylinders 13, whereby the driving cylinders are also attached at the ends. In this manner, a mechanically very stable construction of the retainer device, comprising the retainer ring 6 and the bracing unit 12, is obtained, FIG. 5 shows a cross-section of the dust shield 16 of the shaft boring machine 1 according to FIG. 1 cut along the line V-V of FIG. 2. From FIG. 2 it is apparent that a number of active dust shield segments 15 are attached to displacement cylinders 34 which function radially outwards. A passive dust shield segment 15 is attached to each active dust shield segment 15 by a segment joint 35 by means of an interlocking nosepiece configuration 36 with a neighboring active dust shield segment 15. Through the extensive, substantially closed, configuration of the active dust shield segments 15 and the active mobility of the dust shield segments 15 as well as the passive mobility of the passive dust shield segments 15 the dust shield 16 can be relatively flexibly adjusted to circular diameters of the shaft 4 which are not sufficiently precise, as well.

Furthermore, it may be seen from FIG. 5 that a horizontal bearing configuration 37 exists with which the cutter 17 may be rotated about a horizontal plane by means of a number of horizontal rotation motors 38.

FIG. 6 shows a longitudinal section of the shaft boring machine 1 according to FIG. 1 along the line VI-VI from FIG. 2. It may be seen from FIG. 6 that a scraping channel 39 is meets the scrapers 19 at the radial inner side, through which, in a certain position of the scraper 19 in question, above the horizontal rotating axis, the excavated material collected by said scraper 19 is fed through a filler hole in the face of the cutterwheel 17 to the scraping channel 39 by means of a loading hopper 40 in approximately the middle of the cutterwheel 17 and onto the vertical conveyor belt 25 which runs horizontally at this point over two rollers 41, and by means of said vertical conveyor belt 25 is transported vertically upwards. Furthermore, it may be derived from the illustration of FIG. 6 that the cutterwheel 17 can be rotated about a horizontal axis by means of a vertical bearing configuration 42 driven by the horizontal rotation motors 33.

FIG. 7 shows the embodiment of a shaft boring machine I according to the invention in a step for executing an embodiment of the method according to the invention, specifically the preparation of said shaft boring machine 1 and in said step, the vertical alignment of the central vertical axis of the shaft boring machine 1. In the alignment step the alignment shoes 9 of the alignment unit 8 are placed against the wall of the shaft and the stabilizing feet 21 are in an extended stabilizing position on the shaft floor 3. By controlling the alignment cylinder 7 of the alignment unit 8, when the cutterwheel 17 is not engaged, it is possible to align the shaft boring machine 1 in a vertical position, whereby for this the bracing plates 11 are not lying against the wall of the shaft.

FIG. 8 shows the shaft boring machine 1 in a later step of the embodiment of the method according to the invention, specifically the bracing of the shaft boring machine 1 against the wall of the shaft 4 in that the bracing plates 11 are placed against the wall of the shaft 4 with a very high pressure obtained through the relatively large sized bracing cylinder 13. In this braced configuration of the shaft boring machine 1 the alignment shoes 9 of the alignment unit 8 are placed at a distance to the wall of the shaft 4 and the stabilizing feet 21 are withdrawn and disengaged from the floor of the shaft 3.

In this braced position the cutterwheel 17 is ready for operation for a deepening cycle, and as desired, spray concrete nozzles 22, the anchor device 23 or, as illustrated in FIG. 8, the advance boring device 24 may be put into operation.

FIG. 9 shows the shaft boring machine 1 according to the invention after executing another step of the embodiment of the method according to the invention, specifically the rotation of the cutterwheel 17 solely about the horizontal axis until it has reached a predetermined excavation depth lying deeper than the current shaft floor 3 through the design of one of the outer contours of the cutterwheel 17 in the region of the face 29 and the penetration trough 43 following the neighboring side 31 of the face 29. In order to cut the penetration trough to the predetermined penetration depth, the driving cylinder 10 passing through the machine frame 5 by means of the bracing carriage 14 is continuously shortened such that the cutterwheel 17, rotating in this step solely about the horizontal axis, due to the effect in particular of the excavation tools 18 of the first group 28 and the excavation tools 18 of the second group 30, is continuously digging below the current level of the shaft floor 3 to the predetermined penetration depth while conveying the excavated material from the penetration trough 43.

FIG. 10 shows the shaft boring machine 1 according to the invention in a later step of the embodiment of the method according to the invention, specifically the rotation of the cutterwheel 17 about the central vertical axis as well as the horizontal axis and stopping the cutterwheel 17 at the penetration depth. In this step, the driving cylinders 10 are at the retracted length upon reaching the predetermined penetration depth such that in rotating the cutterwheel 17 about the central vertical axis as well, the excavation tools 18 of the third group 32 functioning substantially in the horizontal direction and the excavation tools 18 of the second group 30 which, due to the diagonal configuration function to a degree on the horizontal plane, based on the position of the cutterwheel 17 illustrated in FIG. 9, deepen the shaft floor 3 to the sides of the penetration trough 43 while continually removing excavated material, while the excavation tools 18 of the first group 28 are substantially unengaged.

FIG. 11 shows the shaft boring machine 1 according to the invention after completion of the step for deepening the shaft floor 3 by an amount corresponding to the predetermined penetration depth and thereby a deepening cycle in which the cutterwheel 17 is basically rotated 90° from the position according fig, 8 and FIG. 9. in this position of the cutterwheel 17 about half of the shaft floor 3 is deepened in two angle segments of 90° each to a depth corresponding to the predetermined penetration depths of the penetration troughs 43. In continuing to rotate the cutterwheel 17 about the horizontal axis as well as about the central vertical axis approx. 90° more, or at least until a complete circumferential coverage has been obtained with hill accessibility to the wall of the shaft 4 during the rotation, then the shah floor 3 has been deepened to the new depth corresponding to the predetermined penetration depth of the penetration troughs 43.

At this point a subsequent deepening cycle is started in the positioning of the cutterwheel 17 according to FIG. 11 with the cutting of a new penetration trough 43 to a predetermined penetration depth and subsequently rotating the cutterwheel 17 about the central vertical axis, preferably against the rotational direction applied in the previous deepening cycle, until again the location of the cutterwheel 17 in accordance to FIG. 7, or respectively, FIG. 8 has been reached.

Preferably, after completion of a deepening cycle, the vertical position of the shaft boring machine 1 is checked and if necessary, the previously mentioned alignment step is carried out to accommodate deviations.

The invention claimed is:

1. A method for boring a vertical shaft underground, the shaft having a shaft floor, said method comprising the following steps:

providing a shaft boring machine having a cutterwheel rotatable about a horizontal axis and about a vertical axis intersecting the horizontal axis, wherein the vertical axis is a central vertical axis with respect to the circumferential wall of the shaft and rotation of the cutterwheel about the horizontal axis and about the vertical axis is configured to deepen the shaft;

executing a first excavating cycle by the following steps:

bracing the shaft boring machine against a circumferential wall of the shaft;

rotating the cutterwheel solely about the horizontal axis to form a penetration trough extending over the total diameter of the shaft having a penetration depth deeper than the shaft floor;

subsequently, rotating the cutterwheel concurrently about the horizontal axis and in a first direction about the vertical axis approximately 180° with the cutterwheel excavating material to extend the circumferential wall of the shaft and to form a first new shaft floor; and following the first excavating cycle, executing a second excavating cycle by the following steps:

rotating the cutterwheel solely about the horizontal axis to form a penetration trough extending over the total diameter of the shaft having a penetration depth deeper than the first new shaft floor;

subsequently, rotating the cutterwheel concurrently about the horizontal axis and in a second direction, opposite the first direction, about the vertical axis approximately 180° with the cutterwheel excavating material to extend the circumferential wall of the shaft and to form a second new shaft floor.

2. The method of claim 1, wherein said steps of rotating the cutterwheel concurrently about the horizontal axis and about the vertical axis each further comprise continuously removing excavated material from the shaft.

3. The method of claim 1, wherein said steps of rotating the cutterwheel concurrently about the horizontal axis and about the vertical axis are each conducted without deepening the shaft beyond the penetration depth.

* * * * *